US006286645B1

(12) United States Patent
Chen

(10) Patent No.: US 6,286,645 B1
(45) Date of Patent: Sep. 11, 2001

(54) FASTENING STRUCTURE OF SHELL-PROTECTING STRIP OF LUGGAGE

(76) Inventor: Sheng-Chin Chen, No. 59, Hen Chung St., Wu Chile Ta Chia Cheng, Taichung Hsien (TW)

( * ) Notice: Subject to any disclaimer, the term of this patent is extended or adjusted under 35 U.S.C. 154(b) by 0 days.

(21) Appl. No.: 09/534,590

(22) Filed: Mar. 27, 2000

(51) Int. Cl.[7] ..... A45C 5/00; A45C 13/36
(52) U.S. Cl. ..... 190/125; 190/18 R; 190/25
(58) Field of Search ..... 190/18 R, 25, 190/26, 125

(56) References Cited

U.S. PATENT DOCUMENTS 3,313,382 * 4/1967 Rosing et al. ..... 190/125 X
5,004,091 * 4/1991 Natho et al. ..... 190/125 X
5,219,075 * 6/1993 White ..... 190/125 X

FOREIGN PATENT DOCUMENTS

2253024 * 7/1973 (DE) ..... 190/18 R
2816045 * 10/1979 (DE) ..... 190/100
271265 * 8/1989 (DE) ..... 190/18 R

* cited by examiner

*Primary Examiner*—Sue A. Weaver
(74) *Attorney, Agent, or Firm*—Harrison & Egbert

(57) ABSTRACT

A protective strip is fastened to the outer surface of a luggage shell by one or more fastening plates which are attached to the inner surface of the luggage shell. The protective strip is provided with a plurality of retaining bodies, whereas the fastening plates are provided with a plurality of projections corresponding in location to and engageable with the retaining bodies of the protective strip. The fastening plates are attached to the inner surface of the luggage shell such that the projections of the fastening plates are engaged with the retaining bodies of the protective strip via the through holes of the luggage shell.

1 Claim, 9 Drawing Sheets

FASTENING STRUCTURE OF SHELL-PROTECTING STRIP OF LUGGAGE

FIELD OF THE INVENTION

The present invention relates generally to luggage, and more particularly to a structure for fastening a protective strip on the shell of the luggage.

BACKGROUND ART

As illustrated in FIGS. 1 and 2, prior art luggage shell 1 is provided with a protective strip 10, which is fastened to the outer surface of the luggage shell 1 by a plurality of rivets 12 in conjunction with the riveting holes 11.

Such a prior art protective strip 10 as described above is defective in design because it is apt to strip off the luggage shell 1, and because the installment of the protective strip 10 results in an added labor cost to the production of the luggage, and also because the rivets 12 undermine the aesthetic effect of the luggage.

SUMMARY OF THE INVENTION

The primary objective of the present invention is to provide luggage with one or more protective strips which are fastened to the outer surface of the shell of the luggage in such a way that the addition of the protective strips does not complicate the production of the luggage, and that the addition of the protective strips does not undermine the aesthetic effect of the luggage shell.

The objective, features, and advantages of the present invention will be more readily understood upon a thoughtful deliberation of the following detailed description of a preferred embodiment of the present invention with reference to the accompanying drawings.

DETAILED DESCRIPTION OF THE INVENTION

As shown in FIGS. 3–9, one or more protective strips 20 of the preferred embodiment of the present invention are fastened to a luggage shell 1 in conjunction with one or more fastening plates 30.

Figure 1:
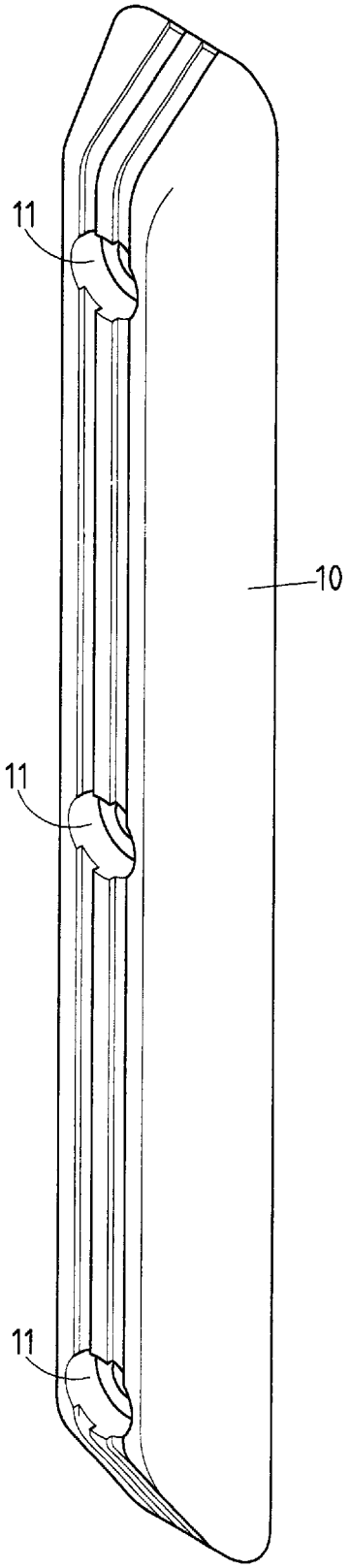
FIG.1 PRIOR ART
FIG. 1 shows an perspective view of a prior art protective strip of the luggage.
Figure 2:
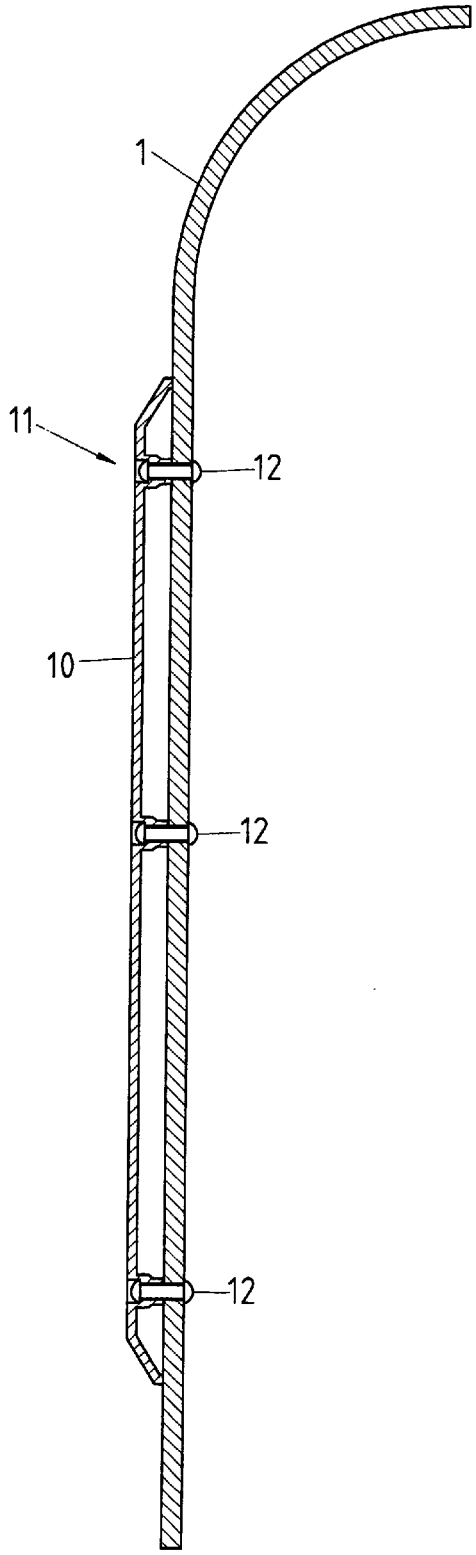
FIG.2 PRIOR ART
FIG. 2 shows a sectional view of the prior art protective strip being fastened to the luggage shell.
Figure 3:
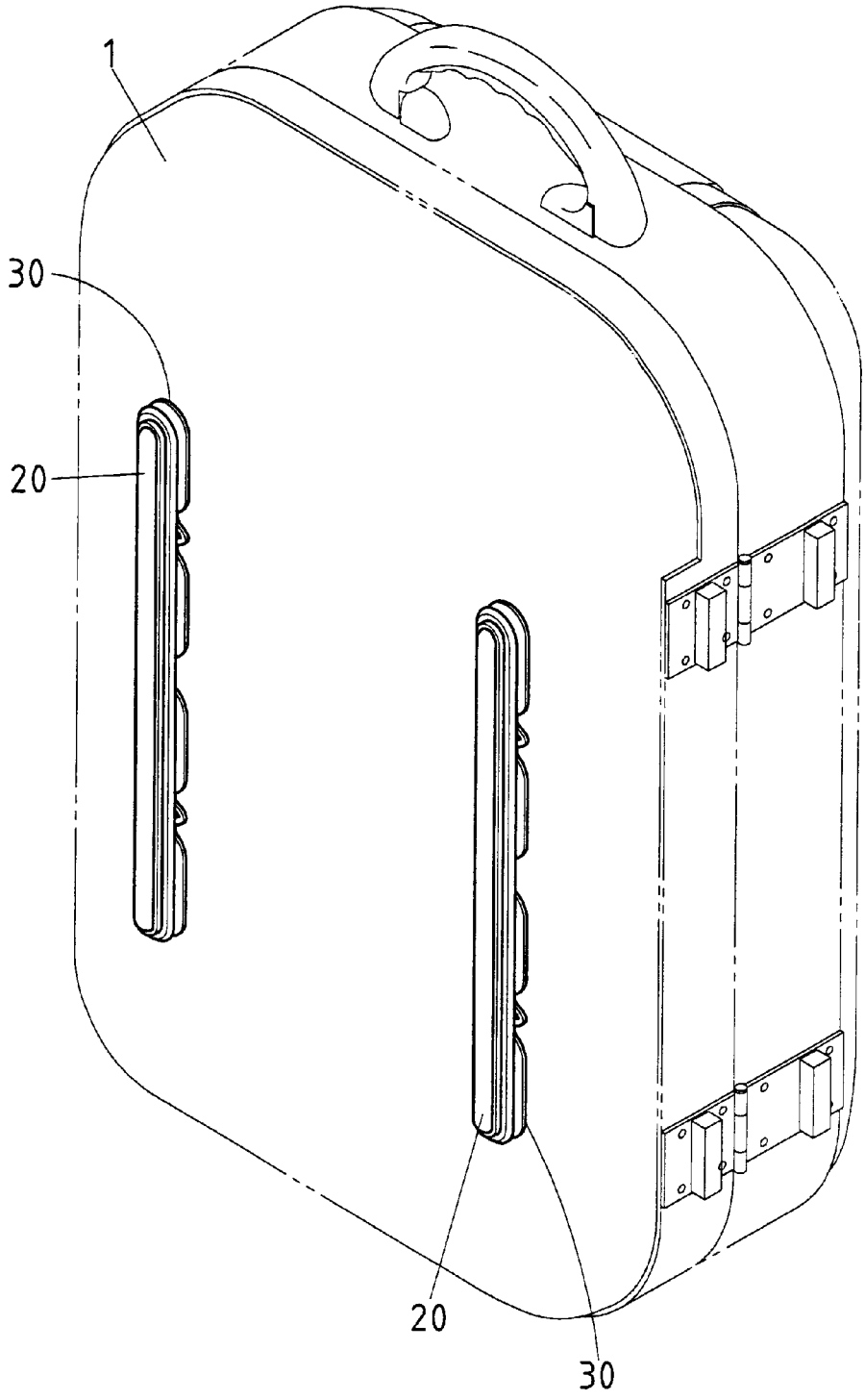
FIG. 3 shows a schematic view of two protective strips of the preferred embodiment of the present invention in conjunction with a luggage to which the two protective strips are fastened.
Figure 4:
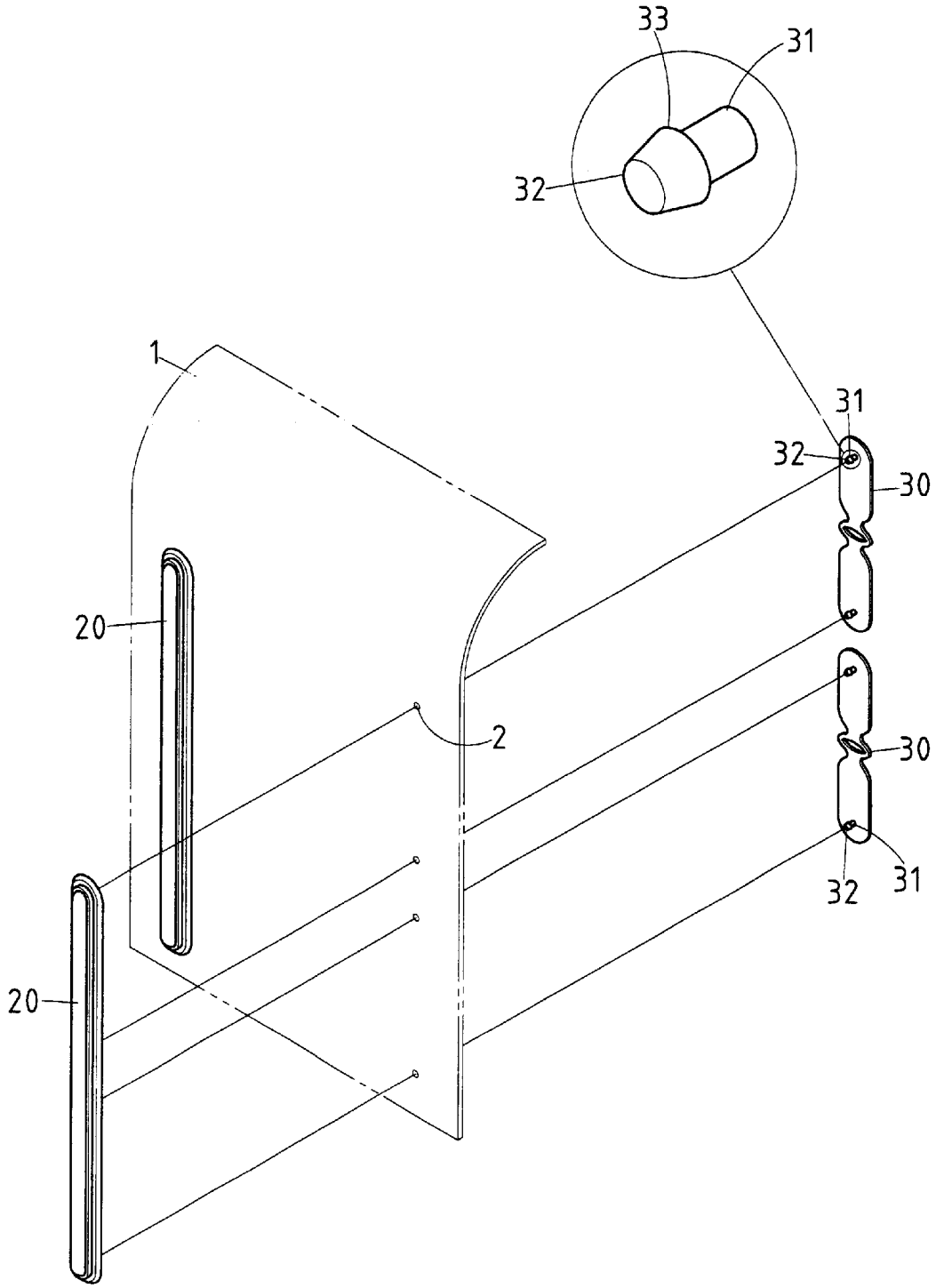
FIG. 4 shows an exploded view of the preferred embodiment of the present invention.
Figure 5:
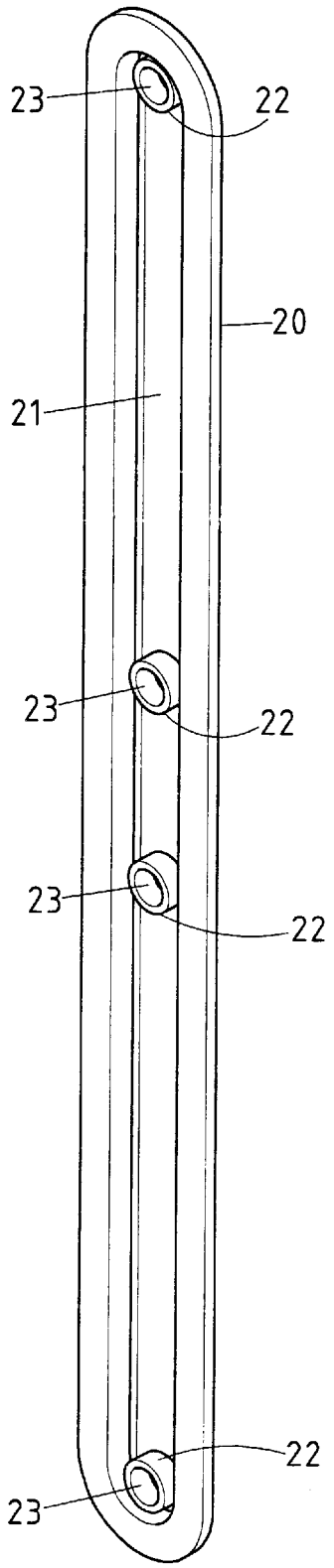
FIG. 5 shows a perspective view of the preferred embodiment of the present invention.
Figure 6:
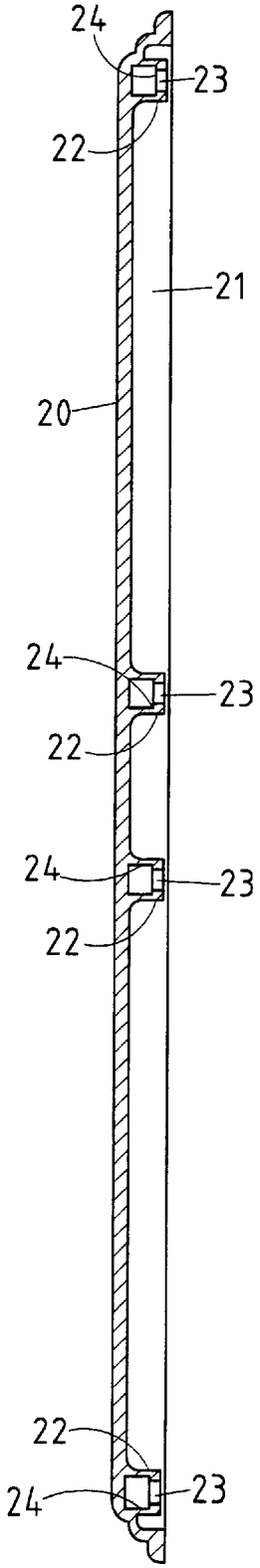
FIG. 6 shows a longitudinal sectional view of the present invention.

As shown in FIGS. 5 and 6, the protective strip 20 embodied in the present invention is provided in one side thereof with a longitudinal slot 21 extending along the direction of the longitudinal axis of the protective strip 20. The longitudinal slot 21 is in turn provided with a plurality of tubular bodies 22 which are separated from one another and are provided with an axial hole 23. The tubular bodies 22 are provided in the inner wall of the midsegment thereof with a stop ring 24.

The protective strip 20 of the present invention is fastened to the outer surface of a luggage shell 1 by a plurality of fastening plates 30, with each being provided with a plurality of projections 31 corresponding in location to the tubular bodies 22 of the protective strip 20. The projections 31 are provided at the free end thereof with a tapered head 32 greater in diameter than the projection 31. Located at the junction of the projection 31 and the tapered head 32 is an annular locating edge 33.

Figure 7:
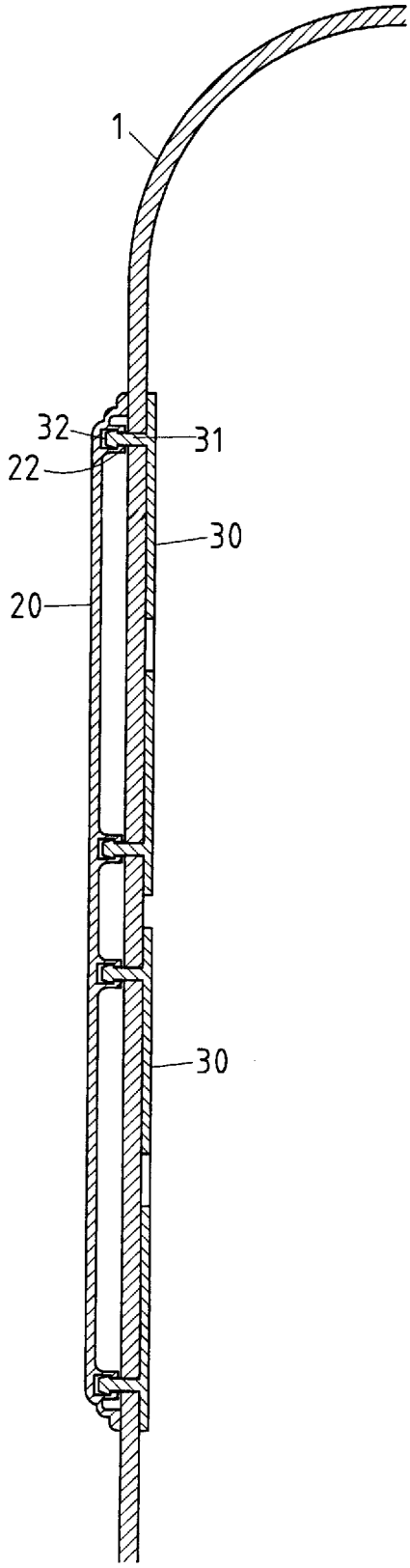
FIG. 7 shows a longitudinal sectional view of the present invention in conjunction with a luggage shell to which the protective strip of the present invention is fastened.
Figure 8:
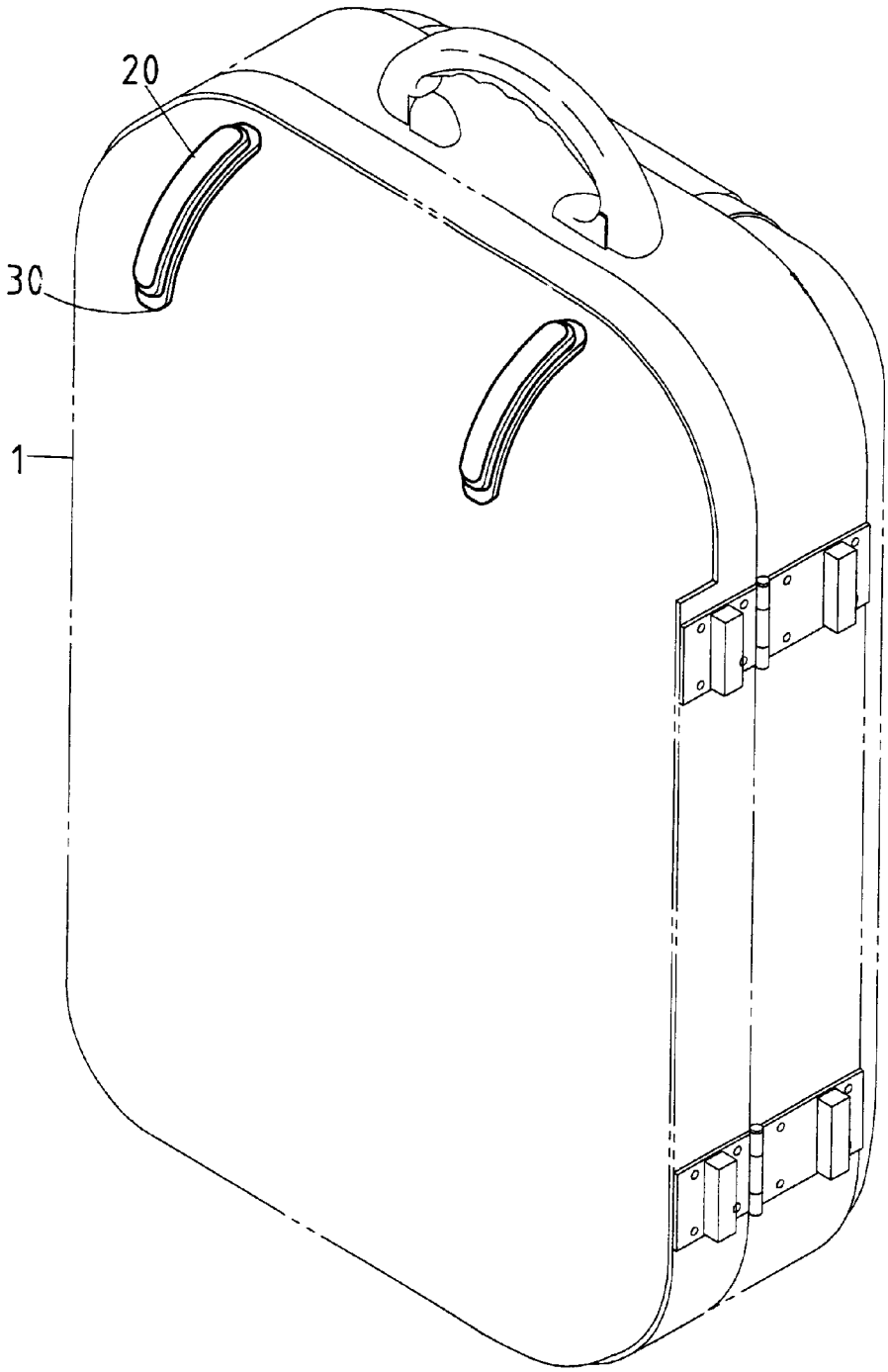
FIG. 8 shows a schematic view of the preferred embodiment of the present invention which is fastened to the curved portion of a luggage shell.
Figure 9:
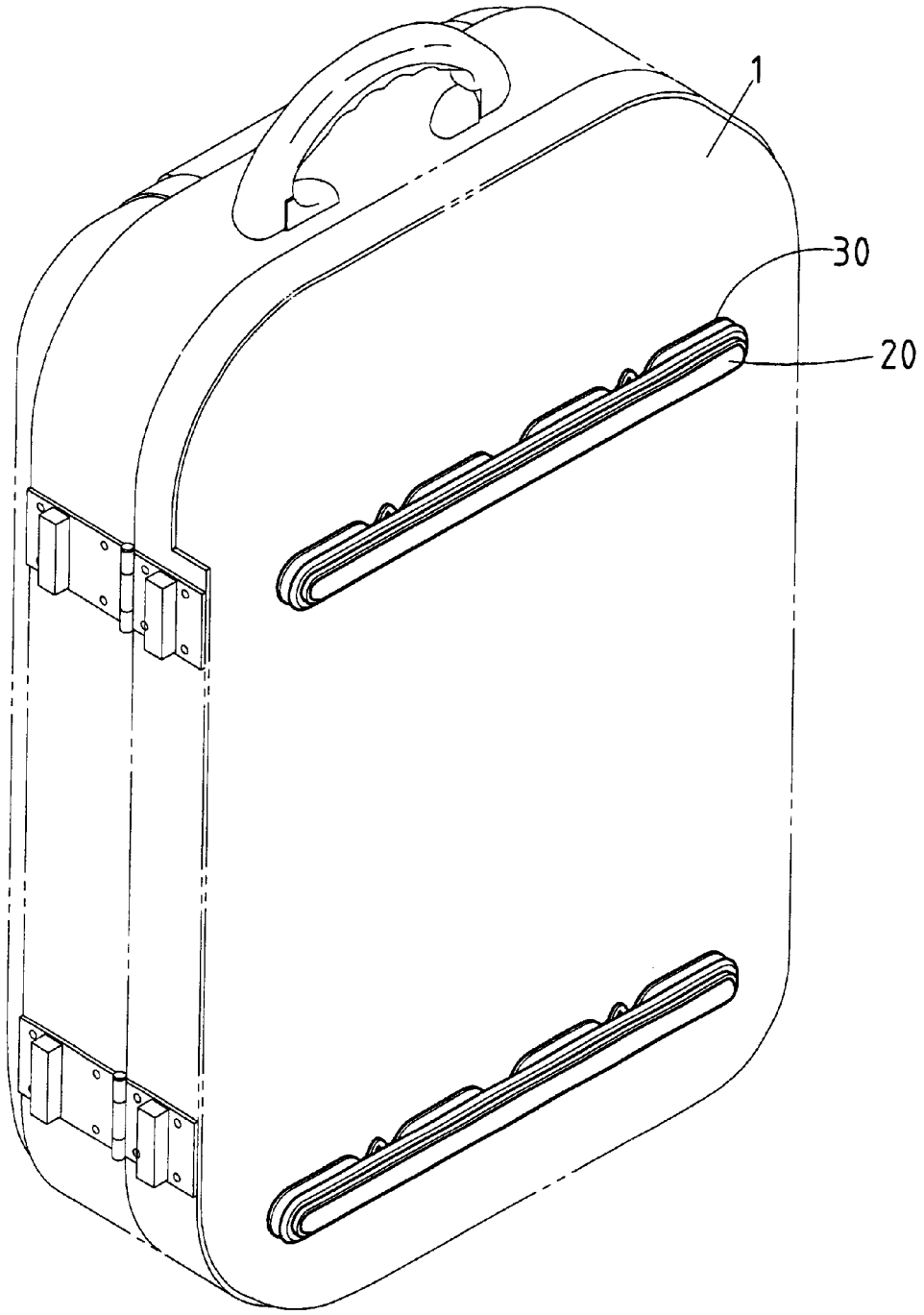
FIG. 9 shows a schematic view of the preferred embodiment of the present invention which is fastened to the outer surface of a luggage shell.

As illustrated in FIG. 7, the protective strip 20 of the present invention is fastened to the outer surface of the luggage shell 1 such that the one side of the protective strip 20 is in contact with the outer surface of the luggage shell 1, and such that the protective strip 20 is fastened to the outer surface of the luggage shell 1 by two fastening plates 30 which are attached to the inner side of the luggage shell 1 such that the tapered head 32 of each projection 31 of the fastening plate 30 is inserted into the tubular body 22 of the protective strip 20 via a through hole 2 of the luggage shell 1, and such that the annular locating edge 33 of the projection 31 is located by the stop ring 24 of the tubular body 22 of the protective strip 20.

The protective strip 20 of the present invention is securely fastened to the luggage shell 1 by a plurality of fastening plates 30 which have a relatively large area of contact with the luggage shell 1. In addition, the protective strip 20 of the present invention is cost-effective and free from the fastening rivets which undermine the overall aesthetic effect of the luggage.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. An apparatus comprising:

a luggage shell having an inner surface and an outer surface, said luggage shell having a plurality of through holes formed therein;

a protective strip having a longitudinal axis, said protective strip having a longitudinal slot extending along said longitudinal axis;

a plurality of tubular bodies received in said longitudinal slot, said plurality of tubular bodies being spaced from each other, each of said plurality of tubular bodies having an axial hole extending therethrough, each of said plurality of tubular bodies having a stop ring formed in said axial hole;

at least one fastening plate having a plurality of projections each with a tapered head formed at an end thereof with an annular locating edge at a juncture of said tapered head with the respective projection, said plurality of projections aligned with respective tubular bodies of said plurality of tubular bodies, said protective strip having a side fastened in contact with said outer surface of said luggage shell, said protective strip being fastened to the fastening plate such that the fastening plate is attached to said inner surface of said luggage shell, said tapered head being inserted into a respective tubular body through a respective through hole of said luggage shell, said annular locating edge received against said stop ring.

* * * * *